US011281149B2

(12) United States Patent
Nagamine et al.

(10) Patent No.: US 11,281,149 B2
(45) Date of Patent: Mar. 22, 2022

(54) IMAGE FORMING APPARATUS, METHOD OF MANUFACTURING IMAGE FORMING APPARATUS, AND METHOD OF DISASSEMBLING IMAGE FORMING APPARATUS

(71) Applicant: CANON KABUSHIKI KAISHA, Tokyo (JP)

(72) Inventors: Shogo Nagamine, Kanagawa (JP); Akira Yoshimura, Shizuoka (JP); Shoji Yamamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/160,237

(22) Filed: Jan. 27, 2021

(65) Prior Publication Data

US 2021/0240126 A1 Aug. 5, 2021

(30) Foreign Application Priority Data

Jan. 30, 2020 (JP) ..... JP2020-014174

(51) Int. Cl.
*G03G 21/16* (2006.01)

(52) U.S. Cl.
CPC ..... *G03G 21/1619* (2013.01); *G03G 21/1633* (2013.01); *G03G 21/1647* (2013.01)

(58) Field of Classification Search
CPC ..... G03G 21/16; G03G 21/1619; G03G 21/1633; G03G 21/1647; G03G 21/181; G03G 2221/1651; G03G 2221/1678; H05K 7/12
See application file for complete search history.

(56) References Cited

U.S. PATENT DOCUMENTS

2015/0098727 A1* 4/2015 Yano ..... G03G 21/1619 399/107
2021/0132521 A1* 5/2021 Yamamoto ..... G03G 21/1666
2021/0200139 A1* 7/2021 Hashimoto ..... G03G 21/1619

FOREIGN PATENT DOCUMENTS

JP 2000-332458 11/2000

* cited by examiner

*Primary Examiner* — Sophia S Chen
(74) *Attorney, Agent, or Firm* — Venable LLP

(57) ABSTRACT

An image forming apparatus including a first member having a first face, a first protrusion and a second protrusion projecting from the first face, and a groove portion formed in the first face, and a second member having a second face provided with a first hole and a second hole. The first protrusion and the second protrusion are inserted into the first hole and the second hole. The second face is superposed on the first face so that the groove portion located between the first member and the second member is in a visible state. The second face is sandwiched between a part of the first protrusion inserted in the first hole and the first face. The second hole in which the second protrusion has been inserted has a gap between the second hole and the second protrusion in an extending direction of the groove portion.

10 Claims, 13 Drawing Sheets

IMAGE FORMING APPARATUS, METHOD OF MANUFACTURING IMAGE FORMING APPARATUS, AND METHOD OF DISASSEMBLING IMAGE FORMING APPARATUS

BACKGROUND OF THE INVENTION

Field of the Invention

The present invention relates to an image forming apparatus using an electrophotographic system, such as a copying machine or a printer, a method of manufacturing an image forming apparatus, and to a method of disassembling an image forming apparatus.

Description of the Related Art

An image forming apparatus is formed of various components and units mounted to a frame. The components and units mounted to the frame include, for example, conveyance roller, a fixing device, and a laser scanner. The conveyance rollers are configured to convey a recording material. The fixing device is configured to fix a toner image on a recording material. The laser scanner is configured to form a toner image. Thus, when the frame is distorted, for example, an image defect due to printing misregistration caused by degradation in conveyance accuracy for the recording material and position misregistration of laser irradiation is liable to occur. In order to prevent such degradation in image quality, the frame is required to have high stiffness. Thus, the stiffness of the frame is increased by providing stays between two side plates opposed to each other in the frame. In recent years, for reduction in weight and cost, not only a frame using a metal plate but also a frame using a combination of a metal plate and a resin has been used. As a method of fastening the metal plate and the resin together, fastening using a screw is generally used. However, a fastening method without using a screw is also used for the purpose of reducing cost. As one of fastening methods without using a screw, thermal caulking is given. In the thermal caulking, fastening is performed by inserting a protrusion of a fastening component made of a thermoplastic resin into a through-hole of a fastened component and, in this state, changing the shape of the protrusion into a stopper shape so that the fastened component is sandwiched between the fastening component and the protrusion having the stopper shape after the change in shape. With the thermal caulking, fastening strength changes in accordance with a thickness of the protrusion or the stopper shape formed after the change in shape.

Meanwhile, in view of environmental preservation, the image forming apparatus is required to be disassembled and separated into different materials so that the materials are recyclable. Specifically, a unit formed by fastening different materials such as a metal plate and a resin is required to be disassembled and separated into the materials corresponding to the metal plate and the resin. As a method of facilitating the disassembly, there has been known a configuration in which a fastened member fastened through thermal caulking has a hole for insertion of a disassembly tool in the vicinity of a thermal caulking portion (Japanese Patent Application Laid-Open No. 2000-332458).

As described above, in the configuration using the thermal caulking, which is to be used for fastening of the unit requiring the stiffness such as the frame and has high fastening strength with the thick protrusion to be changed in shape to have the large stopper portion, a force to be applied to the thermal caulking portion at the time of disassembly is also increased. Further, it is preferred that a tool used at the time of disassembly of the thermal caulking portion be not a special dedicated tool but be a general-purpose tool such as a screwdriver. In the related-art configuration using the thermal caulking, however, the configuration having the increased fastening strength cannot be improved in ease of disassembly without using a special dedicated tool. Thus, there arise problems in that a tool to be used at the time of disassembly is required to be selected in accordance with the fastening strength and, in the related-art configuration using the thermal caulking, both of thermal caulking strength and ease of disassembly cannot be achieved.

SUMMARY OF THE INVENTION

The present invention has been made under the circumstances described above, and has an object to achieve both fastening strength and ease of disassembly at a thermal caulking portion.

In order to solve the above-mentioned problems, according to an embodiment of the present invention, there is provided an image forming apparatus, comprising: a first member having a first face, a first protrusion projecting from the first face, a second protrusion formed in a position apart from the first protrusion and projecting from the first face, and a groove portion formed in the first face; and a second member having a second face provided with a first hole and a second hole, wherein the first member and the second member are fastened to each other to form a frame configured to support an image forming portion configured to form an image on a recording material, wherein the first protrusion is inserted into the first hole, the second protrusion is inserted into the second hole, and the second face is superposed on the first face so that the groove portion located between the first member and the second member is in a visible state, and the second member is fixed to the first member so that the second face is sandwiched between a part of the first protrusion inserted in the first hole and the first face, and wherein the second hole in which the second protrusion has been inserted has a gap between the second hole and the second protrusion in an extending direction of the groove portion.

There is provided a method of manufacturing an image forming apparatus, the method comprising: a first step of providing a first member having a first face, a first protrusion projecting from the first face, a second protrusion formed in a position apart from the first protrusion and projecting from the first face, and a groove portion formed in the first face; a second step of providing a second member having a second face provided with a first hole and a second hole; a third step of, after the first step and the second step, inserting the first protrusion into the first hole and the second protrusion into the second hole and superposing the second face on the first face so that the groove portion located between the first member and the second member is in a visible state; and a fourth step of, after the third step, deforming the first protrusion inserted in the first hole to fix the second member to the first member so that the second face is sandwiched between a part of the first protrusion and the first face, wherein the first member and the second member are fastened to each other to form a frame configured to support an image forming portion configured to form an image on a recording material, and wherein the second hole in which the second protrusion has been inserted has a gap between the second hole and the second protrusion in an extending direction of the groove portion.

There is provided a method of disassembling an image forming apparatus comprising a first member having a first face, a first protrusion projecting from the first face, a second protrusion formed in a position apart from the first protrusion and projecting from the first face, and a groove portion formed in the first face, and a second member having a second face provided with a first hole and a second hole, wherein the image forming apparatus includes a frame formed by inserting the second protrusion into the second hole, superposing the second face on the first face, and fixing the second member to the first member so that the second face is sandwiched between a part of the first protrusion inserted in the first hole and the first face in a state in which the groove portion located between the first member and the second member is in a visible state, and wherein the second hole in which the second protrusion has been inserted has a gap between the second hole and the second protrusion in an extending direction of the groove portion, the method comprising: inserting a tool into the groove; and moving the tool in a direction of separating the second face away from the first face so that the first member and the second member are separated from each other.

Further features of the present invention will become apparent from the following description of exemplary embodiments with reference to the attached drawings.

DESCRIPTION OF THE EMBODIMENTS

Now, detailed description is made of embodiments of the present invention with reference to the drawings.

First Embodiment

[Configuration of Image Forming Apparatus]

Figure 1:
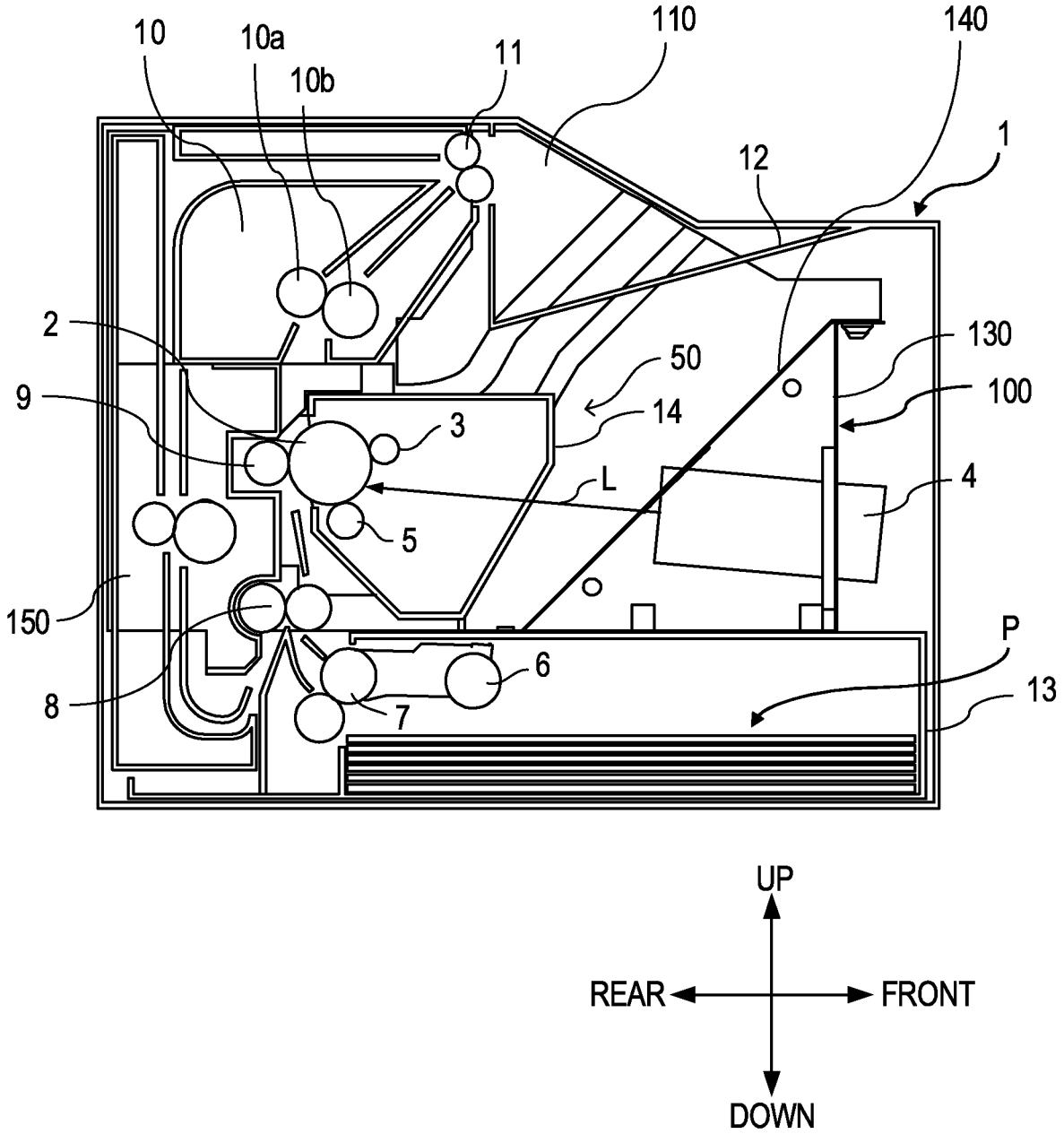
FIG. 1 is a sectional view for illustrating a configuration of an image forming apparatus according to first to third embodiments.

FIG. 1 is a schematic sectional view for illustrating a configuration of an image forming apparatus 1 according to a first embodiment. The image forming apparatus 1 includes a feeding portion, an image forming portion 50, and a fixing device 10. The feeding portion is configured to feed a recording material P. The image forming portion 50 includes, for example, a process cartridge 14, and is configured to form a toner image (developer image) on the recording material P. The fixing device 10 is configured to fix the toner image on the recording material P. In this embodiment, the image forming apparatus 1 of monochrome type including one process cartridge 14 that is mountable and removable exemplifies an electrophotographic image forming apparatus.

The process cartridge 14 includes a photosensitive drum 2, a charging roller 3, and a developing roller 5. The photosensitive drum 2 is a rotatable image bearing member. The charging roller 3 is configured to charge the photosensitive drum 2. The developing roller 5 is configured to develop an electrostatic latent image formed on the photosensitive drum 2 with toner (developer). The photosensitive drum 2 is charged to a uniform potential by the charging roller 3. The photosensitive drum 2 having a surface charged to the uniform potential is irradiated with laser light L emitted from an exposure device 4 corresponding to an exposure unit in accordance with image information. The laser light L scans the photosensitive drum 2 to form the electrostatic latent image on the photosensitive drum 2. Then, the electrostatic latent image formed on the photosensitive drum 2 is developed with the toner by the developing roller 5 to be visualized as a toner image.

Meanwhile, the feeding portion includes, for example, a pickup roller 6, feeding rollers 7, and a feeding tray 13. The recording materials P are stacked on the feeding tray 13. The recording materials P are fed one by one to conveyance rollers 8 by the pickup roller 6 and the feeding rollers 7 in synchronization with the formation of the toner image on the photosensitive drum 2. Then, the recording material P is conveyed by the conveyance rollers 8 to a transfer nip portion formed between the photosensitive drum 2 and a transfer roller 9. The toner image formed on the photosensitive drum 2 is transferred onto the recording material P by the transfer roller 9 at the transfer nip portion.

The recording material P having the toner image transferred thereonto is thereafter conveyed to the fixing device 10 corresponding to a fixing unit so as to be subjected to fixing processing for fixing the unfixed toner image on the recording material P. The fixing device 10 includes a drive roller 10*a* and a fixing roller 10*b*. The fixing roller 10*b* includes a heater built therein. The recording material P is heated and pressurized by the drive roller 10*a* and the fixing roller 10*b*. As a result, the toner image is fixed onto the recording material P. After that, the recording material P is conveyed by delivery rollers 11 to be delivered to and stacked on a delivery tray 12.

In the following description, in a delivery direction of the recording material P conveyed from the delivery rollers 11 in the image forming apparatus 1, an upstream side is defined as "rear", and a downstream side is defined as "front". Further, when the image forming apparatus 1 is viewed from the front side toward the rear side, in an axis direction of the photosensitive drum 2, a right side is defined as "right", and a left side is defined as "left" (see FIG. 3). Moreover, a vertically upper side is defined as "up", and a vertically lower side is defined as "down".

A main body frame 100, which is a frame to be used for the image forming apparatus 1 illustrated in FIG. 1, includes, as described later, a right frame 110, a left frame 120 (not shown in FIG. 1), a first front frame 130, a second front frame 140, and a rear frame 150. The image forming portion 50 including image forming members is arranged on the main body frame 100, and is supported by the main body frame 100. The image forming members are the above-mentioned components and units configured to perform image formation on the recording material P.

[Shapes of Frames forming Main Body Frame]

Figure 2:
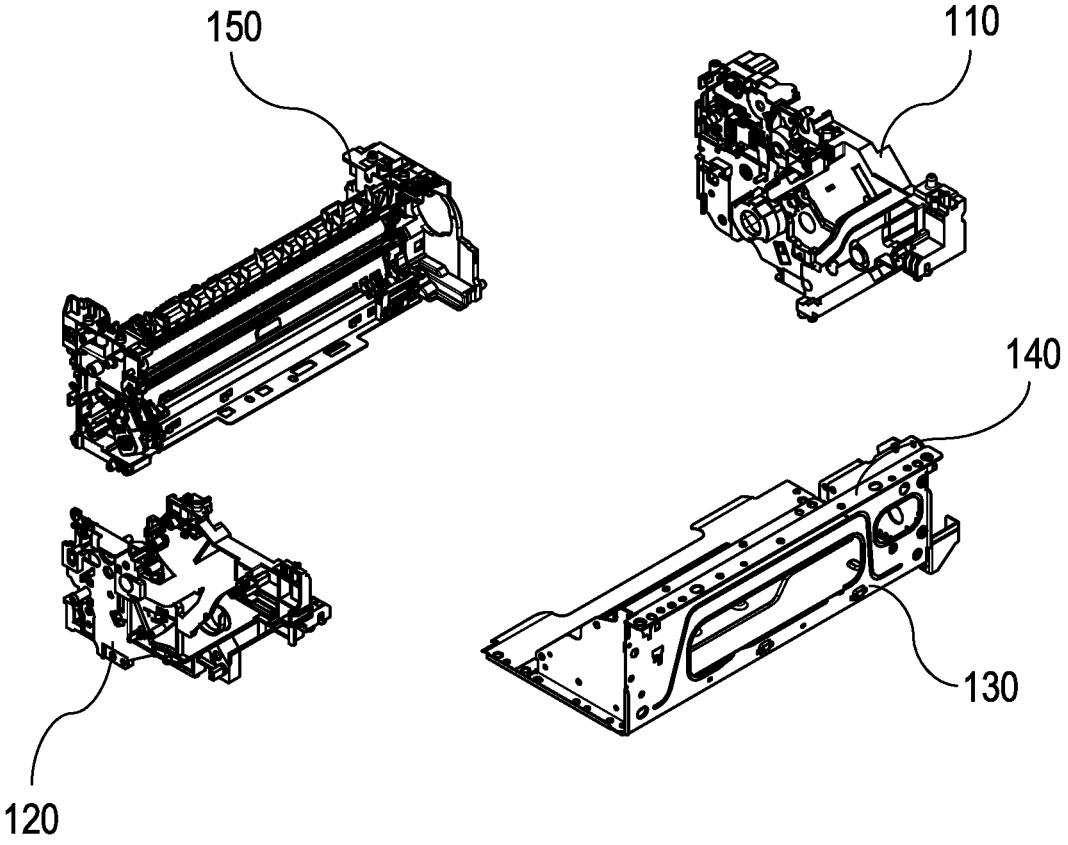
FIG. 2 is an exploded perspective view for illustrating a configuration of a frame according to the first to third embodiments.

FIG. 2 is an exploded perspective view for illustrating a state in which the main body frame 100 is disassembled into the frames that form the main body frame 100, and is a view for illustrating shapes and configurations of the frames. As described above, the main body frame 100 includes the right frame 110, the left frame 120, the first front frame 130, the second front frame 140, and the rear frame 150. The right frame 110 is installed on a right side surface side of the main body frame 100, and is configured to support a right side surface portion of the process cartridge 14. Meanwhile, the left frame 120 is installed on a left side surface side of the main body frame 100, and is configured to support a left side surface portion of the process cartridge 14 described above. The first front frame 130 and the second front frame 140 are installed on a front side of the main body frame 100. The first front frame 130 has an L-like shape. In FIG. 2, the first front frame 130 and the second front frame 140 are illustrated in a state of being fastened together. The second front frame 140 is fastened to the first front frame 130 to form a structural body having a triangular sectional shape (see FIG. 1). The second front frame 140 corresponds to an oblique side of the triangular sectional shape. The rear frame 150 is configured to support the transfer roller 9 and the conveyance rollers 8. When the process cartridge 14 is mounted to the main body frame 100, a conveyance path for the recording material P is formed between the rear frame 150 and the process cartridge 14.

[Configuration of Main Body Frame]

Figure 3:
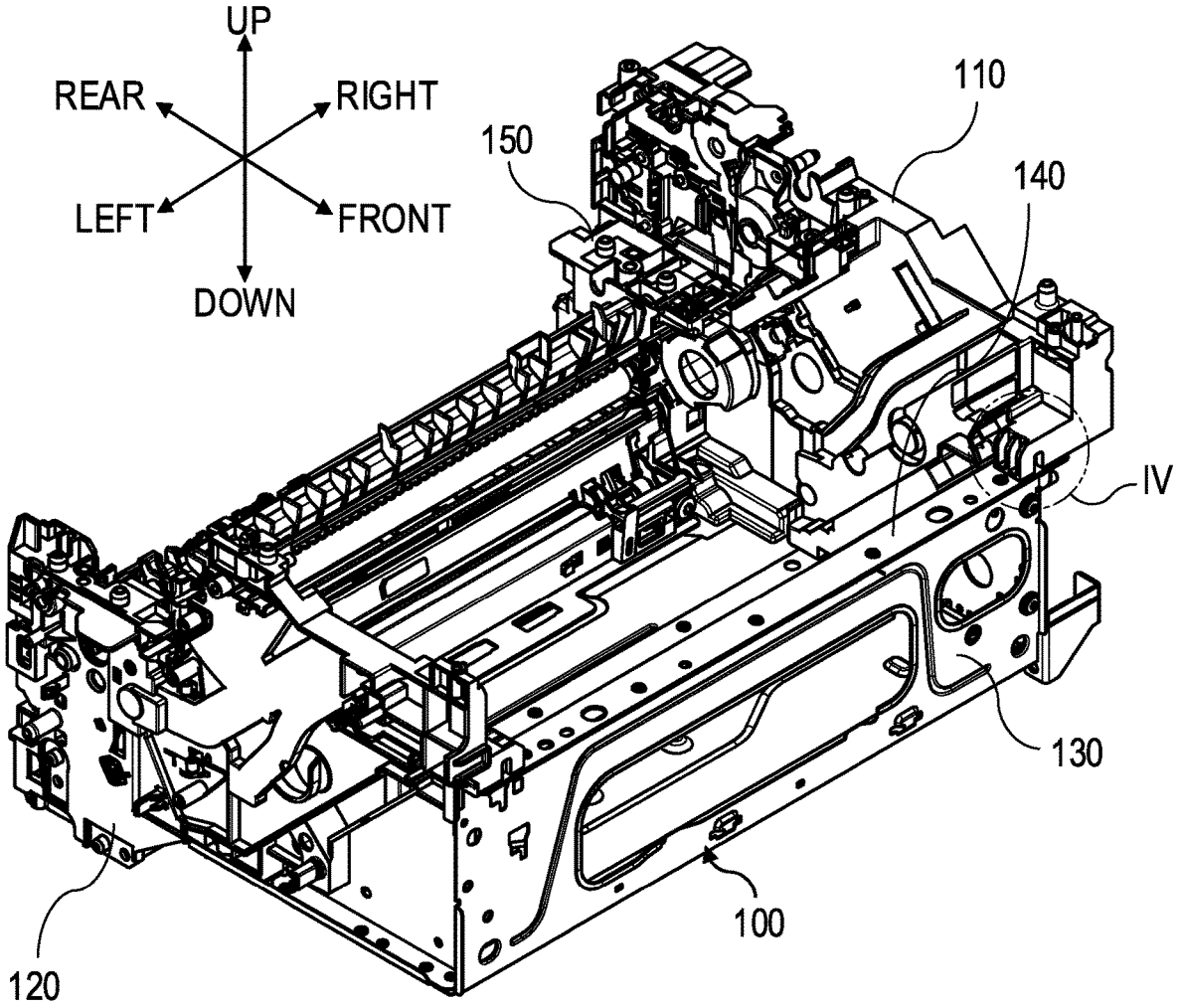
FIG. 3 is a perspective view for illustrating the configuration of the frame according to the first to third embodiments.

FIG. 3 is a perspective view for illustrating a shape of the main body frame 100 formed by assembling the right frame 110, the left frame 120, the first front frame 130, the second front frame 140, and the rear frame 150, which are illustrated in FIG. 2. The main body frame 100 illustrated in FIG. 3 is formed by installing and fixing the right frame 110, the left frame 120, and the rear frame 150 on the first front frame 130 and the second front frame 140. In this embodiment, the right frame 110, the left frame 120, and the rear frame 150 are made of a resin having thermoplasticity. Meanwhile, each of the first front frame 130 and the second front frame 140 is made of a metal plate.

Fastening portions for fastening to fastened members such as the first front frame 130 and the second front frame 140 are provided to fastening members such as the right frame 110, the left frame 120, and the rear frame 150. Fastening through thermal calking to the fastened members is performed at the fastening portions provided to the right frame 110, the left frame 120, and the rear frame 150. The fastening through the thermal caulking corresponds to a method of fastening the fastening portion and the fastened member by inserting a protrusion made of a resin formed on the fastening portion into a hole formed in the fastened member and changing a shape of the protrusion.

The fastening through the thermal caulking between the right frame 110 and a combination of the first front frame 130 and the second front frame 140, which correspond to the fastened members, is performed at the fastening portion at which the thermal caulking is performed (hereinafter referred to as "thermal-caulking fastening portion"), which is provided to the right frame 110. Further, the fastening through the thermal caulking between the rear frame 150 and the right frame 110, which corresponds to the fastened member in this case, is performed at the thermal-caulking fastening portion provided to the rear frame 150.

Similarly, the fastening through the thermal caulking between the left frame 120 and the combination of the first front frame 130 and the second front frame 140, which correspond to the fastened members, is performed at the thermal-caulking fastening portion provided to the left frame 120. Further, the fastening through the thermal caulking between the rear frame 150 and the left frame 120, which corresponds to the fastened member in this case, is performed at the thermal-caulking fastening portion provided to the rear frame 150.

Figure 4:
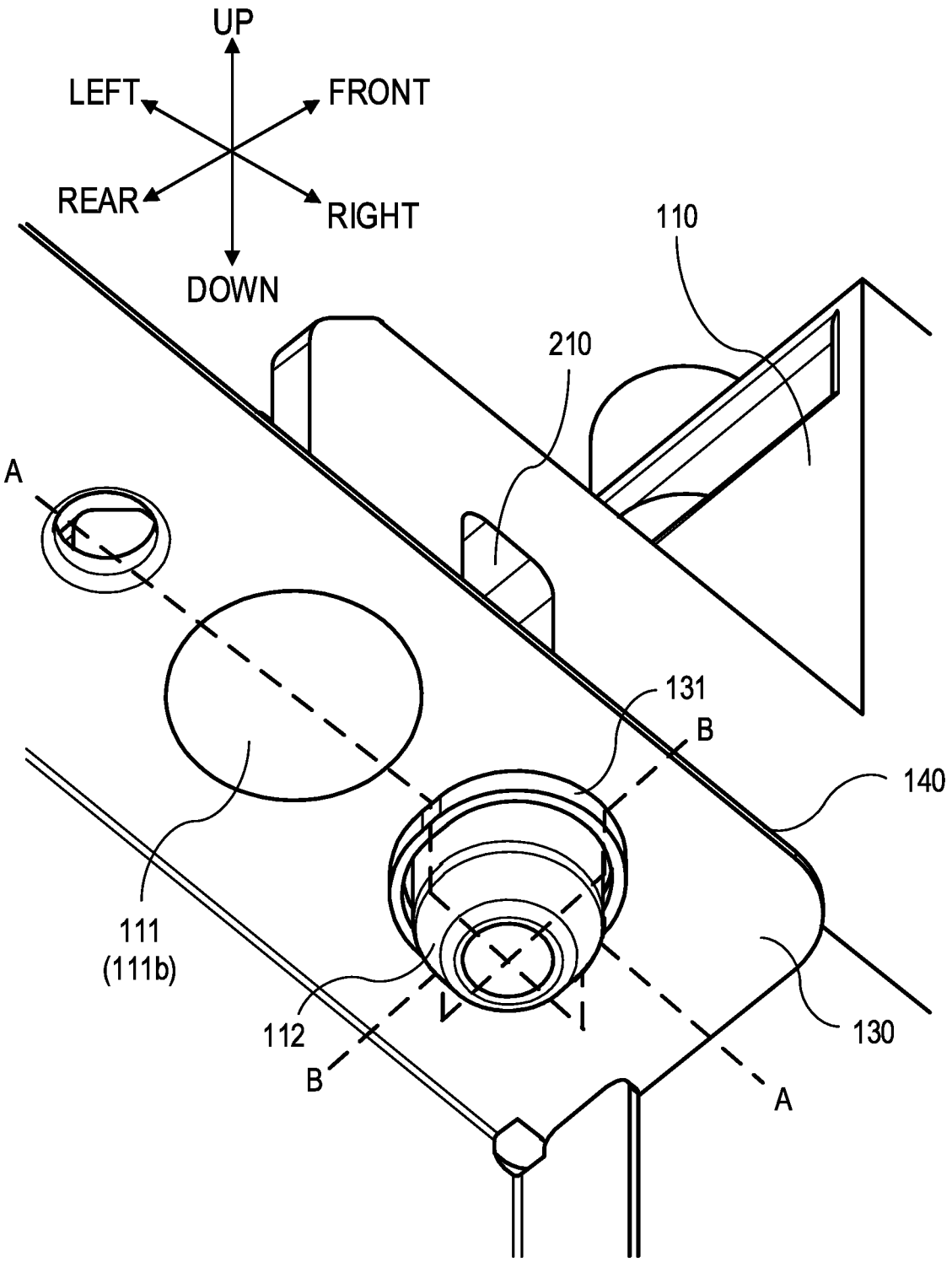
FIG. 4 is a perspective view for illustrating a configuration of a thermal-caulking fastening portion according to the first embodiment.

In FIG. 3, a rib portion of the right frame 110, which is surrounded by a circle IV indicated by a long dashed double-short dashed line, corresponds to the thermal-caulking fastening portion provided to the right frame 110, and is one of fastening regions using the thermal caulking, which are included in the main body frame 100 described above. At this thermal-caulking fastening portion, the right frame 110 and the combination of the first front frame 130 and the second front frame 140, which correspond to the fastened members, are fastened through the thermal caulking. FIG. 4 is a perspective view of the thermal-caulking fastening portion surrounded by the circle IV indicated by the long dashed double-short dashed line of FIG. 3 after the thermal caulking is performed, when viewed from a lower side of the first front frame 130 of the image forming apparatus 1. As illustrated in FIG. 4, the thermal-caulking fastening portion is provided vertically above the first front frame 130 and the second front frame 140. A disassembly hole 210 for insertion of a disassembly tool 200 (see FIG. 6), which is described later, at the time of disassembly of the right frame 110 and the combination of the first front frame 130 and the second front frame 140 is formed in the rib corresponding to the thermal-caulking fastening portion.

A protrusion 111*b* after the thermal caulking, which is illustrated in FIG. 4, is a first protrusion 111. The first protrusion 111 is formed by inserting a protrusion 111*a* (FIG. 5) before the thermal caulking, which is formed on the thermal-caulking fastening portion, into holes (not shown in FIG. 4) formed in the first front frame 130 and the second front frame 140, respectively, and changing a shape of the protrusion 111*a* through heating. In this embodiment, the protrusion 111*a* before the thermal caulking is heated and changed in shape to be turned into the protrusion 111*b* after the thermal caulking, which has a conical shape, to thereby fasten the thermal-caulking fastening portion of the right frame 110 and the combination of the first front frame 130 and the second front frame 140.

Further, a second protrusion 112 is a protrusion (boss) formed on the thermal-caulking fastening portion. When the second protrusion 112 is inserted into a positioning hole 131 formed in the first front frame 130, the right frame 110 is positioned with respect to the first front frame 130. The second protrusion 112 is inserted into the positioning hole 131 formed in the first front frame 130, and a distal end portion of the second protrusion 112 is in a state of projecting toward the first front frame 130. In FIG. 4, the line A-A is a straight line that passes through a center of the second protrusion 112 having a columnar shape and is parallel to an axis extending in a right-and-left direction of FIG. 4. Meanwhile, the line B-B is a straight line that passes through the center of the second protrusion 112 and is orthogonal to the line A-A (specifically, the line B-B extends in a fore-and-aft direction of FIG. 4). A width of the positioning hole 131 in a direction indicated by the line A-A is substantially the same as a diameter of the second protrusion 112 so that the second protrusion 112 inserted into the positioning hole 131 is fitted to the positioning hole 131. Meanwhile, a width of the positioning hole 131 in a direction indicated by the line B-B orthogonal to the line A-A is larger than the diameter of the second protrusion 112 so that gaps are formed at ends in the direction of the line B-B between the positioning hole 131 and the second protrusion 112 inserted in the positioning hole 131. Thus, the positioning hole 131 has an oval hole shape with a larger length in the direction of the line B-B being the fore-and-aft direction than a length in the direction of the line A-A. The right-and-left direction is also referred to as a direction in which the right frame 110 and the left frame 120 may tilt.

As described above, in the image forming apparatus 1, the formation of the toner image and the conveyance of the recording material P are performed. Thus, when the main body frame 100 configured to support the image forming portion 50 including the image forming members such as the components and the units, which are configured to perform the image formation, is distorted, an image defect or malfunction may occur. Thus, suppression of the distortion of the main body frame 100 is important in prevention of, for example, occurrence of an image defect or malfunction. A stress is liable to be concentrated especially on the thermal-caulking fastening portion, which corresponds to a joint between the components. Thus, a firm fastening state is required to be maintained at the thermal-caulking fastening portion so that loosening or breakage at the thermal-caulking fastening portion is prevented.

[Fastening at Thermal-Caulking Fastening Portion]

Figure 5:
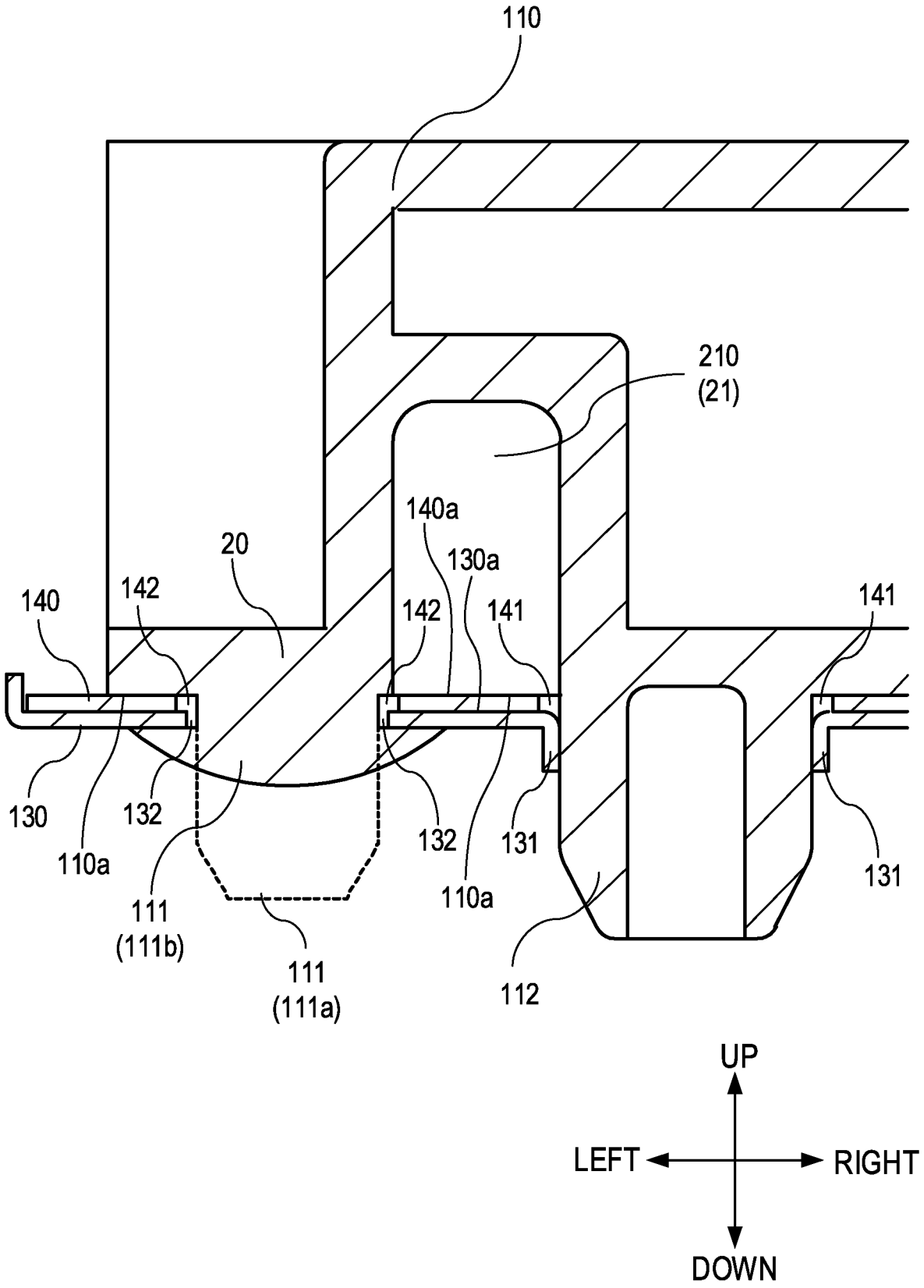
FIG. 5 is a sectional view for illustrating the configuration of the thermal-caulking fastening portion according to the first embodiment.

Next, a configuration of the thermal-caulking fastening portion for improvement of fastening strength between the right frame 110 and the combination of the first front frame 130 and the second front frame 140 is described. FIG. 5 is a sectional view of the thermal-caulking fastening portion fastened to the first front frame 130 and the second front frame 140 illustrated in FIG. 4, which is taken along a plane orthogonal to an axis extending in a fore-and-aft direction of the image forming apparatus 1, specifically, a plane containing the line A-A of FIG. 4. As illustrated in FIG. 5, the right frame 110 corresponding to the fastening member includes a fixing portion 20. The fixing portion 20 has a first face 110*a*, the first protrusion 111, and the second protrusion 112. The first face 110*a* faces vertically downward. The first protrusion 111 and the second protrusion 112 project from the first face 110*a* toward the first front frame 130 and the second front frame 140. The first protrusion 111 and the second protrusion 112 are arranged in the stated order in a direction from the left frame 120 toward the right frame 110 (direction from the left to the right of FIG. 5). The first protrusion 111 has a columnar shape, and has an inclined surface formed on an outer periphery of a distal end portion. Similarly to the first protrusion 111, the second protrusion 112 also has a columnar shape, and has an inclined surface formed on an outer periphery of a distal end portion. In contrast to the first protrusion 111, however, the second protrusion 112 has a hollow columnar shape. Further, a groove portion 21 is formed in the fixing portion 20 between the first protrusion 111 and the second protrusion 112. The groove portion 21 is open on a side opposed to the first front frame 130 and the second front frame 140, and passes across the right frame 110 in the fore-and-aft direction of FIG. 5.

Meanwhile, the first front frame 130, which corresponds to the fastened member, has a second face 130*a*. A hole 132 and the positioning hole 131 are formed in the second face 130*a*. The first protrusion 111 passes through the hole 132, and the second protrusion 112 passes through the positioning hole 131. Similarly, the second front frame 140 has a second face 140*a*. Holes 141 and 142 are formed in the second face 140*a*. The first protrusion 111 passes through the hole 142, and the second protrusion 112 passes through the hole 141. The positioning hole 131 has a peripheral edge portion extending in a vertically downward direction so as to be fitted over the second protrusion 112.

Subsequently, a method of providing the fastening region by fastening the thermal-caulking fastening portion, and the first front frame 130 and the second front frame 140 is described. First, the right frame 110 having the fixing portion 20, the first front frame 130 having the positioning hole 131 and the hole 132, and the second front frame 140 having the holes 141 and 142 are prepared. Then, the first protrusion 111 of the fixing portion 20 is allowed to pass through the hole 142 of the second front frame 140 and the hole 132 of the first front frame 130, and the second protrusion 112 is allowed to pass through the hole 141 of the second front frame 140 and the positioning hole 131 of the first front frame 130 in the stated order. As a result, the second face 140*a* of the second front frame 140 and the second face 130*a* of the first front frame 130, which are opposed to the right frame 110, are superposed on the first face 110*a* of the right frame 110, which is opposed to the first front frame 130 and the second front frame 140, in the stated order. Then, the protrusion 111*a* before the thermal caulking (indicated by a broken line of FIG. 5), which is the first protrusion 111 of the fixing portion 20 before the thermal caulking, is heated to be changed in shape. As a result, the second face 130*a* and the second face 140*a* are thermally caulked so as to be sandwiched between the protrusion 111*b* after the thermal caulking, which has the distal end portion changed in shape to have the conical shape, and the first face 110*a*, to thereby fasten the first front frame 130 and the second front frame 140 to the right frame 110.

Meanwhile, when the second protrusion 112 is inserted into the positioning hole 131 formed in the first front frame 130, the second protrusion 112 and the positioning hole 131 are fitted together to position the right frame 110 and the first front frame 130 with respect to each other. As described above, the second protrusion 112 is configured to position the right frame 110 and the first front frame 130. Further, the second protrusion 112 and the positioning hole 131 also function as a rotation stopper for the positioning.

Further, when the right frame 110 is fastened to the first front frame 130 and the second front frame 140, the opening of the groove portion 21 formed in the right frame 110 is closed by the first front frame 130 and the second front frame 140. As a result, the disassembly hole 210 in a visible state, into which the disassembly tool 200 described later is to be inserted, is formed.

In this case, when a force for pulling the right frame 110 away from the first front frame 130 and the second front frame 140 is applied in an upward direction of FIG. 5 at the thermal-caulking fastening portion after the thermal caulking, which is illustrated in FIG. 5, the following state is achieved. Specifically, the right frame 110 and the combination of the first front frame 130 and the second front frame 140 are deflected at the protrusion 111*b* after the thermal caulking as a starting point by the force for pulling the right frame 110 away from the first front frame 130 and the second front frame 140. At this time, the second protrusion 112 and the positioning hole 131 are fitted together. Hence, the right frame 110 and the combination of the first front frame 130 and the second front frame 140 are misaligned to bite into each other to generate a resistance force against the pulling force. As described above, the first protrusion 111 to be thermally caulked is formed in the vicinity of the second protrusion 112 that is inserted into the positioning hole 131 to be fitted therein and positioned. Hence, a resistance force generated by the second protrusion 112 fitted into the positioning hole 131 is additionally applied as compared to related-art fastening through thermal caulking. As a result, fastening strength is improved at the thermal-caulking fastening portion according to this embodiment.

[Disassembly of Frames at Thermal-Caulking Fastening Portion]

Subsequently, a method of disassembling the frames at the thermal-caulking fastening portion is described. In this embodiment, the right frame 110 is made of a resin, and the first front frame 130 and the second front frame 140 are each made of a metal plate. Thus, for environmental preservation, the resin and the metal plate are required to be separated before being discarded. Before the image forming apparatus 1 is discarded, the right frame 110 and the combination of the first front frame 130 and the second front frame 140, which are fastened together, are required to be disassembled (separated).

Figure 6:
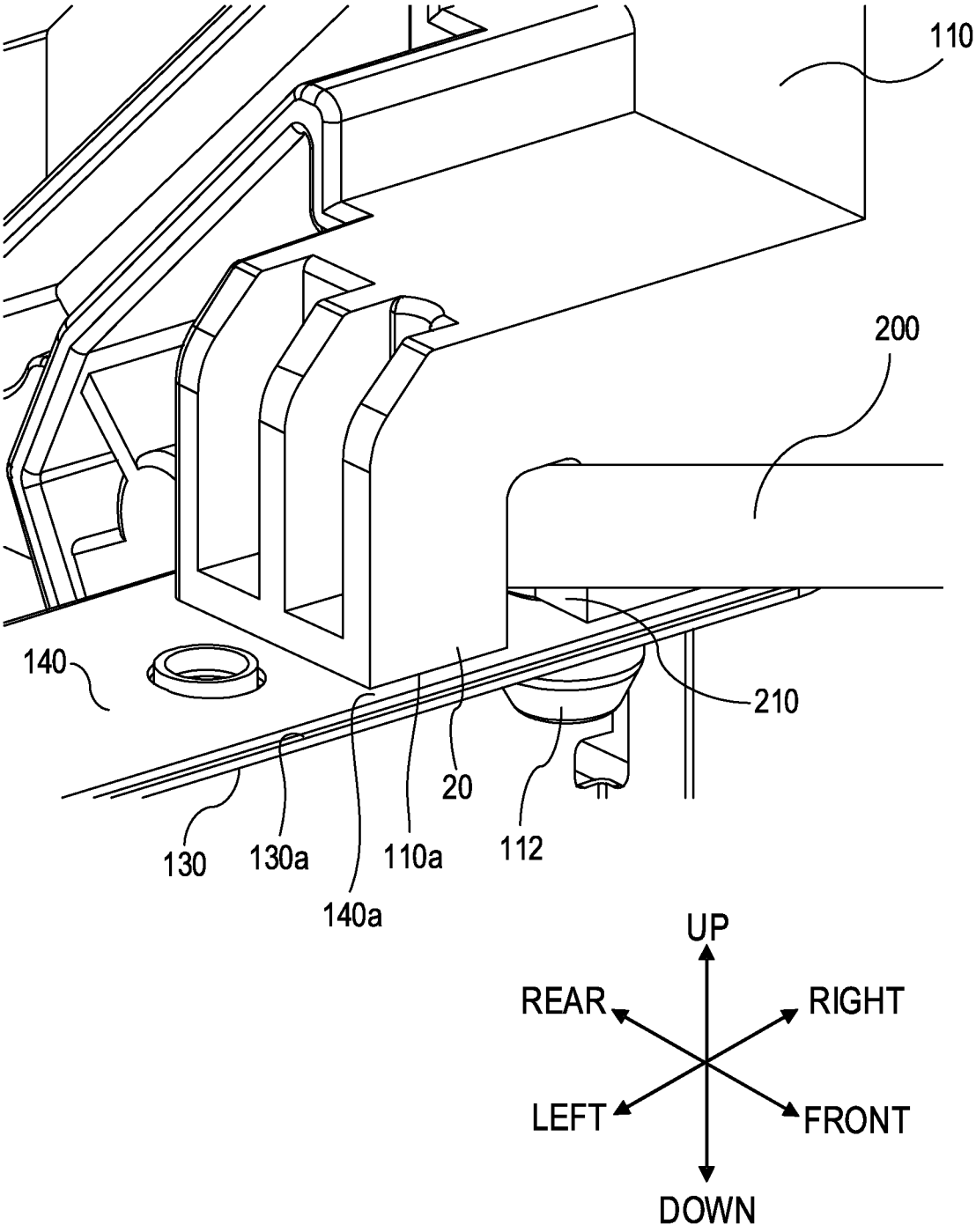
FIG. 6 is a perspective view for illustrating a method of disassembling frames at the thermal-caulking fastening portion according to the first embodiment.

FIG. 6 is a perspective view for illustrating a state in which the disassembly tool 200 is inserted into the disassembly hole 210 formed in the right frame 110 so as to disassemble the right frame 110 and the combination of the first front frame 130 and the second front frame 140. As illustrated in FIG. 5, the disassembly hole 210 for insertion of the disassembly tool 200 at a time of disassembly of the frames at the thermal-caulking fastening portion is formed between the protrusion 111*b* after the thermal caulking and the second protrusion 112. As illustrated in FIG. 6, the disassembly tool 200 is inserted into the disassembly hole 210 from a front side of FIG. 6 to bring a lower part of a distal end of the disassembly tool 200 into contact with the second front frame 140 and an upper part of the disassembly tool 200 into contact with an upper part of an insertion port of the disassembly hole 210 for the disassembly tool 200. Then, when a force is applied so as to push a front side of the disassembly tool 200 of FIG. 6 in an upward direction of FIG. 6, the right frame 110 is separated (disassembled) from the first front frame 130 and the second front frame 140. Specifically, the force is applied to the disassembly tool 200 in a direction of separating the first face 110*a* of the right frame 110 away from the second face 140*a* of the second front frame 140 and the second face 130*a* of the first front frame 130, which are opposed to the right frame 110, and hence the frames are disassembled at the thermal-caulking fastening portion. The disassembly tool 200 is a rod-shaped general-purpose tool such as a screwdriver. Any tool having stiffness needed at the time of separation of the right frame 110 from the first front frame 130 and the second front frame 140 may be used.

Figure 7:
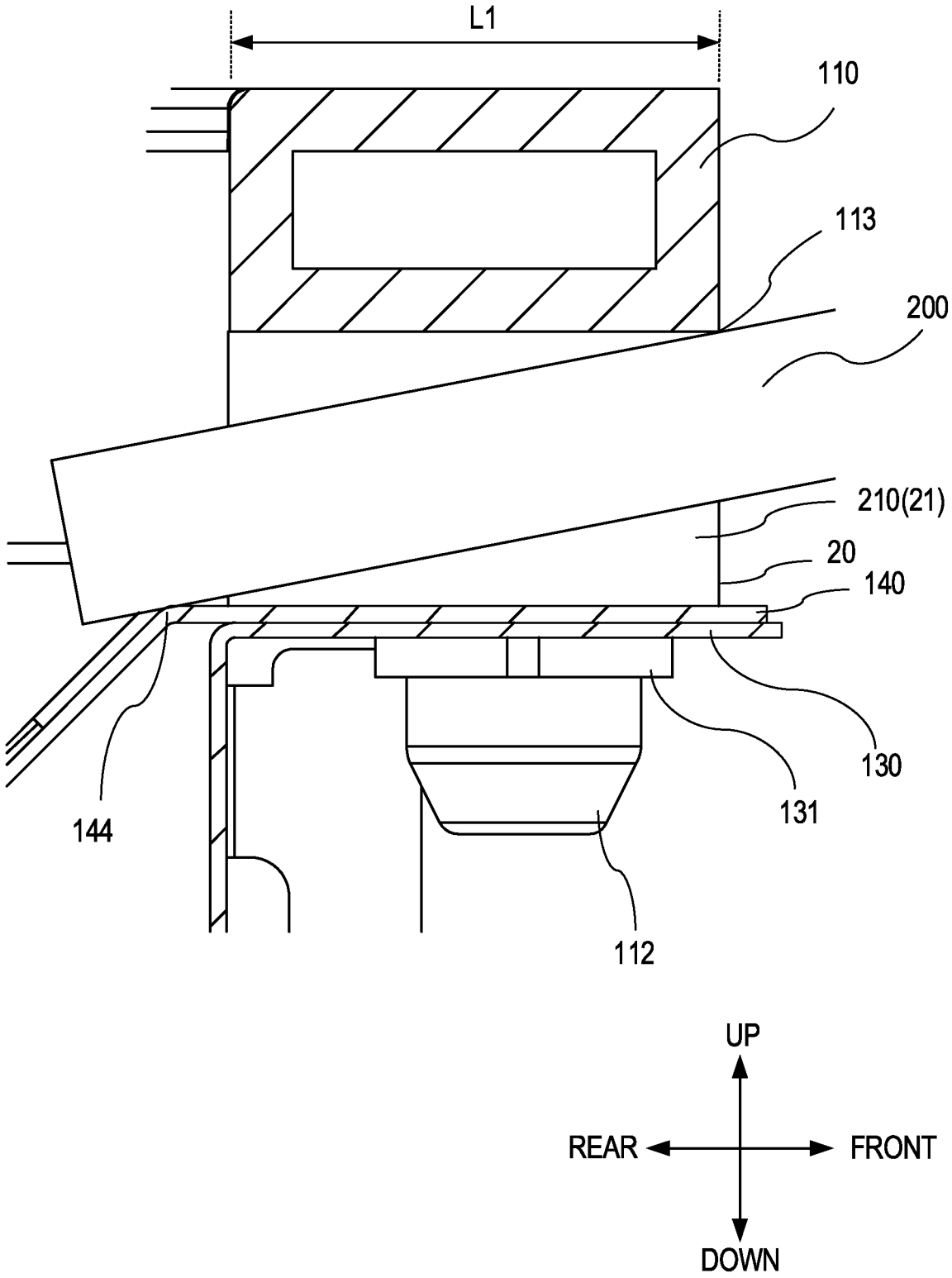
FIG. 7 is a sectional view for illustrating the method of disassembling the frames at the thermal-caulking fastening portion according to the first embodiment.

FIG. 7 is a sectional view of the disassembly hole 210 in a state in which the disassembly tool 200 illustrated in FIG. 6 is inserted, which is taken along a plane orthogonal to an axis extending in the right-and-left direction of FIG. 6. As illustrated in FIG. 7, the disassembly tool 200 inserted into the disassembly hole 210 passes through the disassembly hole 210. As a result, a vertically lower portion of the distal end portion of the disassembly tool 200 in an insertion direction thereof (direction from a front side toward a rear side of FIG. 7) is in contact with a second corner portion 144 of the second front frame 140. Meanwhile, a vertically upper portion of the disassembly tool 200, which is located in the vicinity of the insertion port of the disassembly hole 210, is in contact with a first corner portion 113 of the insertion port of the disassembly hole 210 of the right frame 110. Then, a force is applied with the first corner portion 113 as a point of action and the second corner portion 144 as a fulcrum so as to push the disassembly tool 200 in an upward direction of FIG. 7 to thereby apply a force for pulling the right frame 110 away from the first front frame 130 and the second front frame 140 to the right frame 110. As a result, the right frame 110 is pulled away from the first front frame 130 and the second front frame 140 to be separated (disassembled). A length (width) of the fixing portion 20 of the right frame 110 in the fore-and-aft direction of FIG. 7 is indicated by L1 in FIG. 7.

Figure 8:
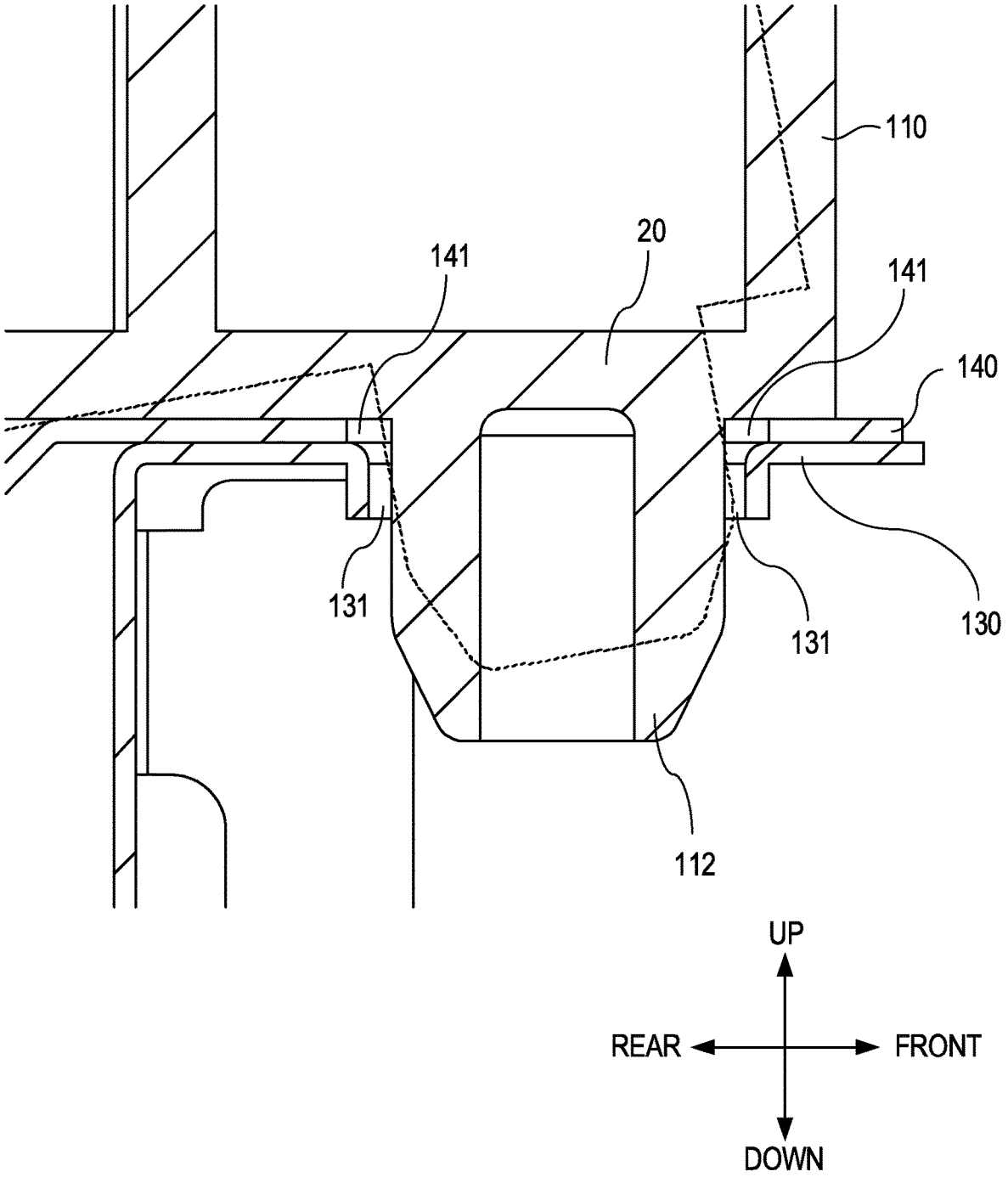
FIG. 8 is a sectional view for illustrating a behavior at the time of disassembly of the frames at the thermal-caulking fastening portion according to the first embodiment.

FIG. 8 is a view for illustrating a state in which the second protrusion 112 is removed from the positioning hole 131 when the right frame 110 is pulled away from the first front frame 130 and the second front frame 140. FIG. 8 is a sectional view of the second protrusion 112 illustrated in FIG. 4, which is taken along the line B-B for illustrating a plane orthogonal to the axis extending in the right-and-left direction of the image forming apparatus 1, specifically, a plane orthogonal to the line A-A of FIG. 4. As illustrated in FIG. 8, the positioning hole 131 of the first front frame 130 has an oval hole shape elongated in the insertion direction of the disassembly tool 200. Specifically, the width of the positioning hole 131 in a direction orthogonal to the insertion direction of the disassembly tool 200 (fore-and-aft direction of FIG. 8) is substantially the same as the diameter of the second protrusion 112 so as to be fitted over the second protrusion 112. Meanwhile, the positioning hole 131 has the oval hole shape larger than the diameter of the second protrusion 112 in a direction parallel to the insertion direction of the disassembly tool 200. Thus, the gaps are formed between the second protrusion 112 and the positioning hole 131 at the ends in the insertion direction of the disassembly tool 200. Thus, when the force for pulling the right frame 110 away from the first front frame 130 and the second front frame 140 is applied in an upward direction of FIG. 8 by the disassembly tool 200, the second protrusion 112 can tilt only in the insertion direction of the disassembly tool 200 (fore-and-aft direction of FIG. 8). More specifically, because of the gaps formed between the second protrusion 112 indicated by a solid line of FIG. 8 and the positioning hole 131 at the ends in the insertion direction of the disassembly tool 200, the second protrusion 112 is pulled up (pulled out) while being inclined in an obliquely upward direction as indicated by a broken line of FIG. 8 without biting into a wall of the positioning hole 131.

As described above, the second protrusion 112 inserted into the positioning hole 131 does not act as a resistance force at the time of pulling of the right frame 110 away from the combination of the first front frame 130 and the second front frame 140 with use of the disassembly tool 200. Thus, only a fastening force with the protrusion 111*b* after the thermal caulking acts as a resistance force at the time of pulling of the right frame 110 away from the combination of the first front frame 130 and the second front frame 140 with use of the disassembly tool 200.

As described above, when the fastening strength is to be achieved only through the thermal caulking, the protrusion 111*a* before the thermal caulking is required to be increased in size to increase a shape of the protrusion 111*b* after the thermal caulking, which is formed by heating and changing the shape. However, when the shape of the protrusion 111*b* after the thermal caulking is increased in size so as to increase the fastening strength, a force needed to perform the disassembly of the frames at the thermal-caulking fastening portion is also increased. Further, the increased size of the protrusion 111*a* before the thermal caulking leads to an increase in size of the image forming apparatus 1. Meanwhile, in this embodiment, the fastening region using the thermal caulking is set in the vicinity of the positioning hole 131. As a result, the fastening strength achieved through the thermal caulking can be improved without an increase in size of the protrusion 111*a* before the thermal caulking. Further, at the time of disassembly of the frames at the thermal-caulking fastening portion, only the resistance force of the thermal caulking portion, which is the same as the resistance force in the related art, is applied. Thus, the resistance force at the time of disassembly is not increased as a result of setting of the fastening region using the thermal caulking in the vicinity of the positioning hole 131. Thus, the frames can be disassembled at the thermal-caulking fastening portion by applying the same force as that applied in the related art.

In this embodiment, the groove portion 21, which is elongated and has a recessed shape formed in the right frame 110, forms the disassembly hole 210 when the right frame 110 is fastened to the combination of the first front frame 130 and the second front frame 140. However, the configuration of the disassembly hole 210 is not limited to that described above. For example, an elongated groove portion having a recessed shape may be formed in the combination of the first front frame 130 and the second front frame 140. In this case, when the right frame 110 and the combination of the first front frame 130 and the second front frame 140 are fastened together, the disassembly hole 210 is formed. Further, the disassembly hole 210 may be formed so that both of the right frame 110 and the combination of the first front frame 130 and the second front frame 140 have groove portions, each having a recessed shape, respectively. Further, in FIG. 5, the protrusion 111*b* after the thermal caulking, which has a conical shape formed by heating and changing the shape. However, the shape of the protrusion 111*b* after the thermal caulking is not limited to the conical shape. For example, the shape of the protrusion 111*b* may be a semi-spherical shape, with which the same fastening force as the fastening force obtained with the conical shape is obtained.

Further, in this embodiment, the second protrusion 112 is formed on the same member (right frame 110) on which the first protrusion 111 is formed. The same effects are obtained even with a configuration in which, for example, the second protrusion 112 is formed on the fastened member such as the first front frame 130 or the second front frame 140 or a configuration in which the positioning hole 131 is formed in the right frame 110. Further, the metal-plate frames have been described as the fastened members to be fastened through the thermal calking. However, the same effects are obtained even when the fastened members are resin frames. Further, in this embodiment, the fastening of the frames using a combination of the thermal caulking and another fastening method has been described. Even in the frame configuration using only the thermal caulking, however, the same effects are obtained.

As described above, according to the first embodiment, both of the fastening strength and ease of disassembly at the thermal caulking portion can be achieved.

Figure 9:
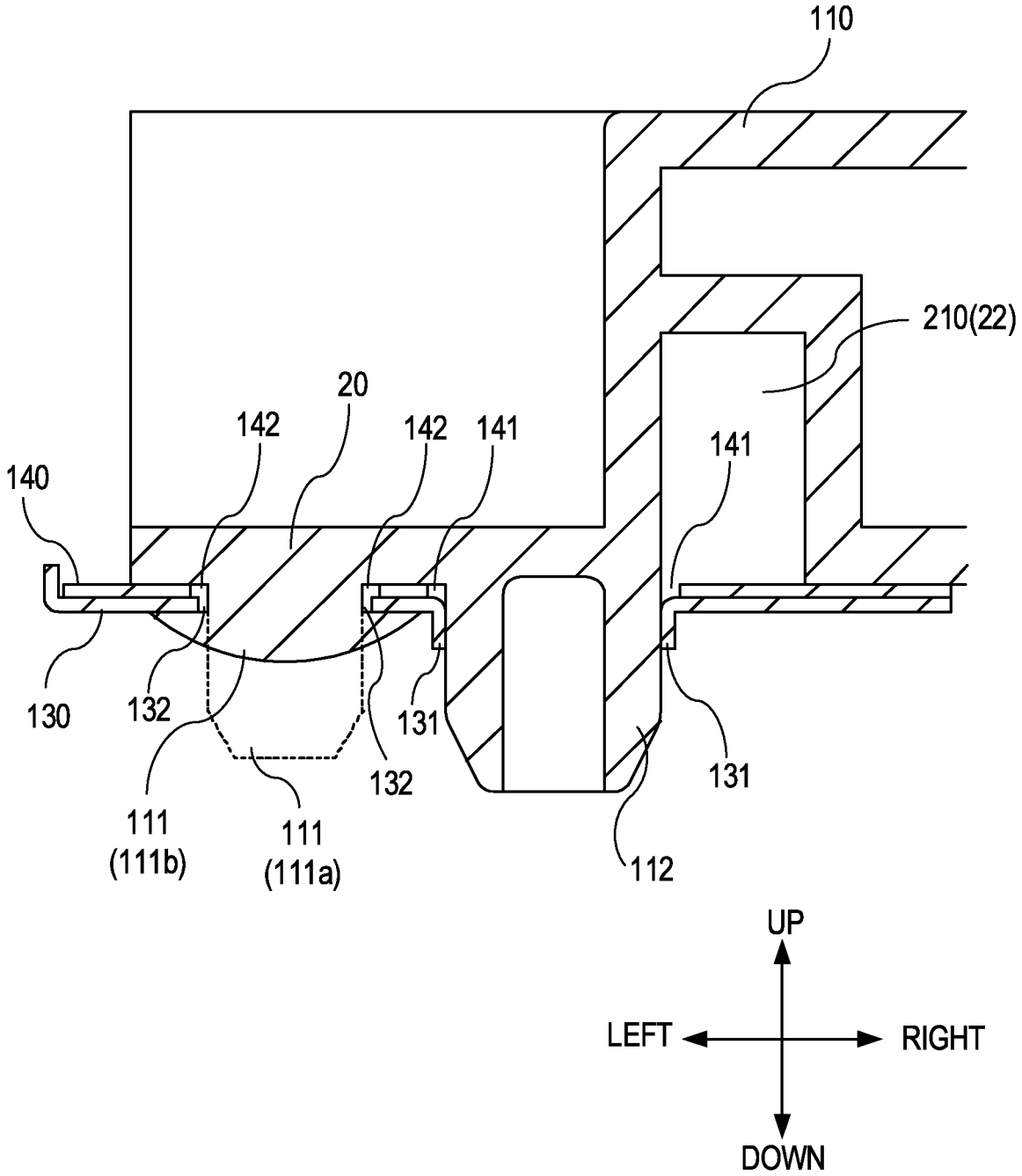
FIG. 9 is a sectional view for illustrating a configuration of a thermal-caulking fastening portion of a modification example of the first embodiment.

In this embodiment, the groove portion 21 for forming the disassembly hole 210 is formed between the first protrusion 111 and the second protrusion 112. However, the position at which the groove portion 21 is formed is not limited to that described above. For example, as a modification example, as illustrated in FIG. 9, a groove portion 22 may be formed on a side of the second protrusion 112, which is opposite to the first protrusion 111, so as to be adjacent to the second protrusion 112. This modification example is now described with reference to FIG. 9.

Similarly to FIG. 5, FIG. 9 is a sectional view of the thermal-caulking fastening portion formed on the right frame 110 of this modification example, which is taken along a plane orthogonal to the axis extending in the fore-and-aft direction of the image forming apparatus 1, specifically, a plane containing the line A-A of FIG. 4. The groove portion 22 is formed on a side of the second protrusion 112, which is opposite to the first protrusion 111, so as to be adjacent to the second protrusion 112. When the right frame 110 is fastened to the first front frame 130 and the second front frame 140, the disassembly hole 210 is formed. In this modification example, basic configurations of the fixing portion 20, the first front frame 130, and the second front frame 140 are the same as those in the first embodiment except that the position at which the groove portion 22 is formed is different from the position of the groove portion 21 described in the first embodiment. Thus, the positioning hole 131 has an oval hole shape that is elongated in the direction parallel to the insertion direction of the disassembly tool 200, and gaps are formed between the second protrusion 112 and the positioning hole 131 at ends in the direction parallel to the insertion direction of the disassembly tool 200. Thus, when a force for pulling the right frame 110 away from the combination of the first front frame 130 and the second front frame 140 is applied by the disassembly tool 200, the second protrusion 112 can tilt without biting into the wall of the positioning hole 131.

In this modification example, the groove portion 22 is formed so as to be adjacent to the second protrusion 112. However, even when the groove portion 22 is formed on the side of the second protrusion 112, which is opposite to the first protrusion 111, so as to be located in the vicinity of the second protrusion 112, the same effects are obtained. However, as the position of the groove portion 22 is set farther apart from the second protrusion 112, a degree of tilt of the second protrusion 112 toward the protrusion 111*b* after the thermal caulking is increased at the time of disassembly with the disassembly tool 200. As a result, the second protrusion 112 bites into the positioning hole 131, and it becomes difficult to disassemble (separate) the right frame 110 and the combination of the first front frame 130 and the second front frame 140. Thus, it is preferred that the groove portion 22 be formed at a position close to the second protrusion 112.

Second Embodiment

In the first embodiment, when the right frame 110 and the combination of the first front frame 130 and the second front frame 140 are fastened together to close the opening of the groove portion 21 formed in the right frame 110, the disassembly hole 210 is formed. In a second embodiment, the disassembly hole 210, which is formed to pass through the right frame 110, is described.

[Configuration of Disassembly Hole]

Figure 10:
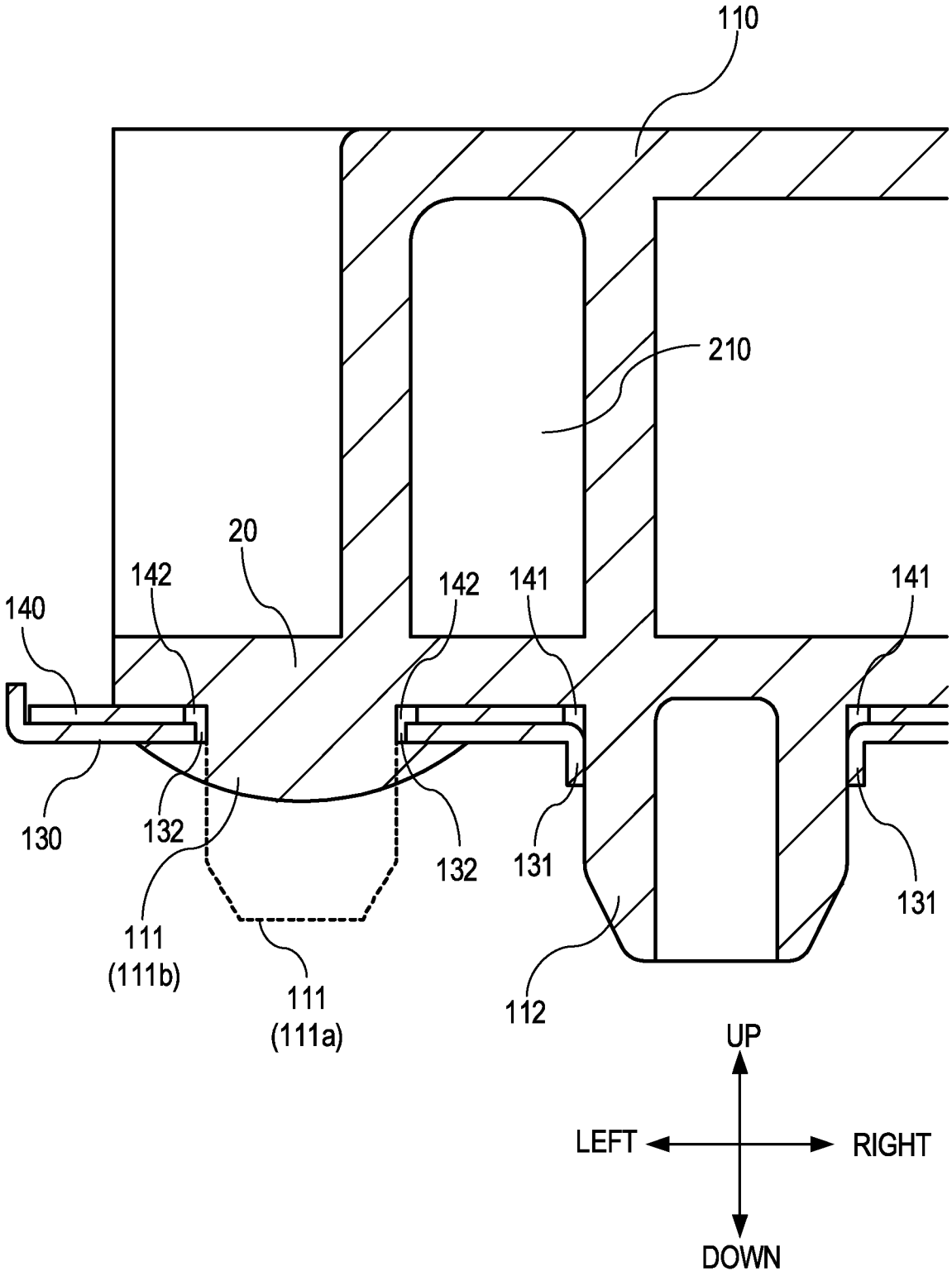
FIG. 10 is a sectional view for illustrating a configuration of a thermal-caulking fastening portion according to the second embodiment.

Similarly to FIG. 5 of the first embodiment, FIG. 10 is a sectional view of the thermal-caulking fastening portion provided to the right frame 110 according to this embodiment, which is taken along a plane orthogonal to the axis extending in the fore-and-aft direction of the image forming apparatus 1, specifically, along a plane containing the line A-A of FIG. 4. The thermal-caulking fastening portion according to this embodiment is different from the above-mentioned thermal-caulking fastening portion according to the first embodiment in the configuration of the disassembly hole 210. Other configurations of the thermal-caulking fastening portion provided to the right frame 110 and configurations of the first front frame 130 and the second front frame 140 are the same as the configurations of the first embodiment. In this embodiment, the same configurations as the configurations in the first embodiment are described with the same reference symbols, and description thereof is herein omitted.

The disassembly hole 210 passing through the right frame 110 in the fore-and-aft direction is formed between the first protrusion 111 and the second protrusion 112 formed on the fixing portion 20 of the thermal-caulking fastening portion according to this embodiment. In the first embodiment, the groove portion 21 for forming the disassembly hole 210 is a groove portion being open on the side opposed to the first front frame 130 and the second front frame 140. Meanwhile, the disassembly hole 210 according to this embodiment is a through-hole passing through the right frame 110. The disassembly hole 210 has opening ports on a front-side wall and a rear-side wall of the right frame 110 in the fore-and-aft direction of the image forming apparatus 1 of FIG. 10. Thus, the disassembly hole 210 is different from the groove portion 21 having the opening according to the first embodiment. Further, the disassembly hole 210 according to this embodiment has a length in the vertical direction, which is larger than a length of the disassembly hole 210 according to the first embodiment in the vertical direction. A method of fastening the right frame 110 and the combination of the first front frame 130 and the second front frame 140 is the same as that in the first embodiment, and description thereof is omitted.

[Disassembly of Frames at Thermal-Caulking Fastening Portion]

Figure 11:
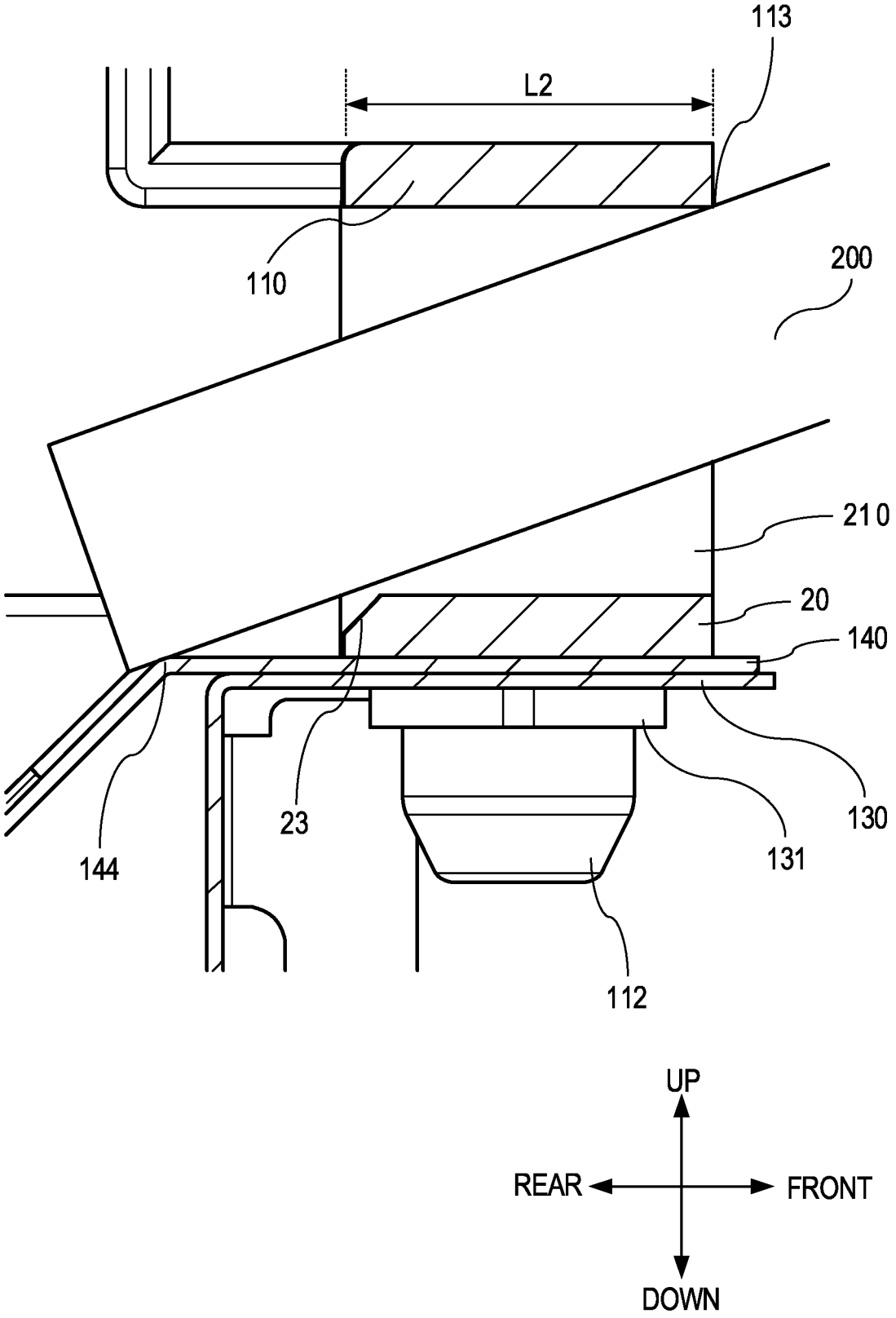
FIG. 11 is a sectional view for illustrating a method of disassembling the frames at the thermal-caulking fastening portion according to the second embodiment.

Subsequently, a method of disassembling the frames at the thermal-caulking fastening portion according to the second embodiment is described. FIG. 11 is a sectional view of the disassembly hole 210 illustrated in FIG. 10 in a state in which the disassembly tool 200 is inserted, which is taken along a plane parallel to the line B-B of FIG. 4, which is orthogonal to the axis extending in the right-and-left direction of FIG. 6. As illustrated in FIG. 11, the disassembly tool 200 inserted into the disassembly hole 210 passes through the disassembly hole 210, and the vertically lower portion of a distal end portion of the disassembly tool 200 in the insertion direction thereof (direction from a front side toward a rear side of FIG. 11) is in contact with the second corner portion 144 of the second front frame 140. Meanwhile, the vertically upper portion of the disassembly tool 200, which is located in the vicinity of the insertion port of the disassembly hole 210, is in contact with the first corner portion 113 of the insertion port of the disassembly hole 210 formed in the right frame 110. Then, a force is applied with the first corner portion 113 as a point of action and the second corner portion 144 as a fulcrum so as to push the disassembly tool 200 in an upward direction of FIG. 11 to thereby apply a force for pulling the right frame 110 away from the combination of the first front frame 130 and the second front frame 140 to the right frame 110. Even in this embodiment, as in the first embodiment, when the pulling force is applied by the disassembly tool 200, the second protrusion 112 can tilt without biting into the wall of the positioning hole 131 only in the insertion direction of the disassembly tool 200. As a result, the right frame 110 is pulled away from the combination of the first front frame 130 and the second front frame 140 to be separated (disassembled).

In FIG. 11, a length (width) of the fixing portion 20 of the right frame 110 in the fore-and-aft direction of FIG. 11 is indicated by L2. The width L2 of the fixing portion 20 according to this embodiment is shorter than the width L1 of the fixing portion 20 according to the first embodiment, which is illustrated in FIG. 7. Further, an inclined surface 23 is formed in an end of the disassembly hole 210 in the vicinity of the opening port on the rear side of FIG. 11 so as to be inclined toward a side of the first front frame 130 and the second front frame 140 so that the disassembly tool 200 inserted into the disassembly hole 210 is not brought into contact with the disassembly hole 210 in the vicinity of the opening port on the rear side. As described above, the disassembly hole 210 according to this embodiment is formed through the right frame 110. Thus, when the width L2 of the fixing portion 20 is the same as the width of the second front frame 140, the distal end portion of the disassembly tool 200 inserted into the disassembly hole 210 cannot be brought into contact with the second front frame 140. Thus, the width L2 of the fixing portion 20 according to this embodiment is set to be shorter than the width L1 of the fixing portion 20 according to the first embodiment. Further, a length of the disassembly hole 210 in the vertical direction is set to be larger than a length of the disassembly hole 210 in the vertical direction in the first embodiment, and the inclined surface 23 is formed so that the disassembly tool 200 inserted into the disassembly hole 210 is not brought into contact with the surface of the disassembly hole 210 on the first front frame 130 and the second front frame 140 side.

In this embodiment, the disassembly hole 210 is formed in the right frame 110. However, the disassembly hole 210 may be formed in the first front frame 130 and the second front frame 140. In this case, the same effects as those obtained with the disassembly hole 210 formed in the right frame 110 can be obtained.

As described above, according to the second embodiment, both of the fastening strength and ease of disassembly at the thermal caulking portion can be achieved.

Third Embodiment

In the first and second embodiments, the first protrusion 111 and the second protrusion 112 of the fixing portion 20 are formed so as to be arranged side by side in the direction in which the right frame 110 and the left frame 120 may tilt, specifically, in the right-and-left direction of the image forming apparatus 1. In a third embodiment, a first protrusion 111 and a second protrusion 112 of the fixing portion 20 are formed so as to be arranged side by side in a direction orthogonal to the direction in which the right frame 110 and the left frame 120 may tilt, specifically, in the fore-and-aft direction of the image forming apparatus 1.

[Configuration of Thermal-caulking Fastening Portion]

Figure 12:
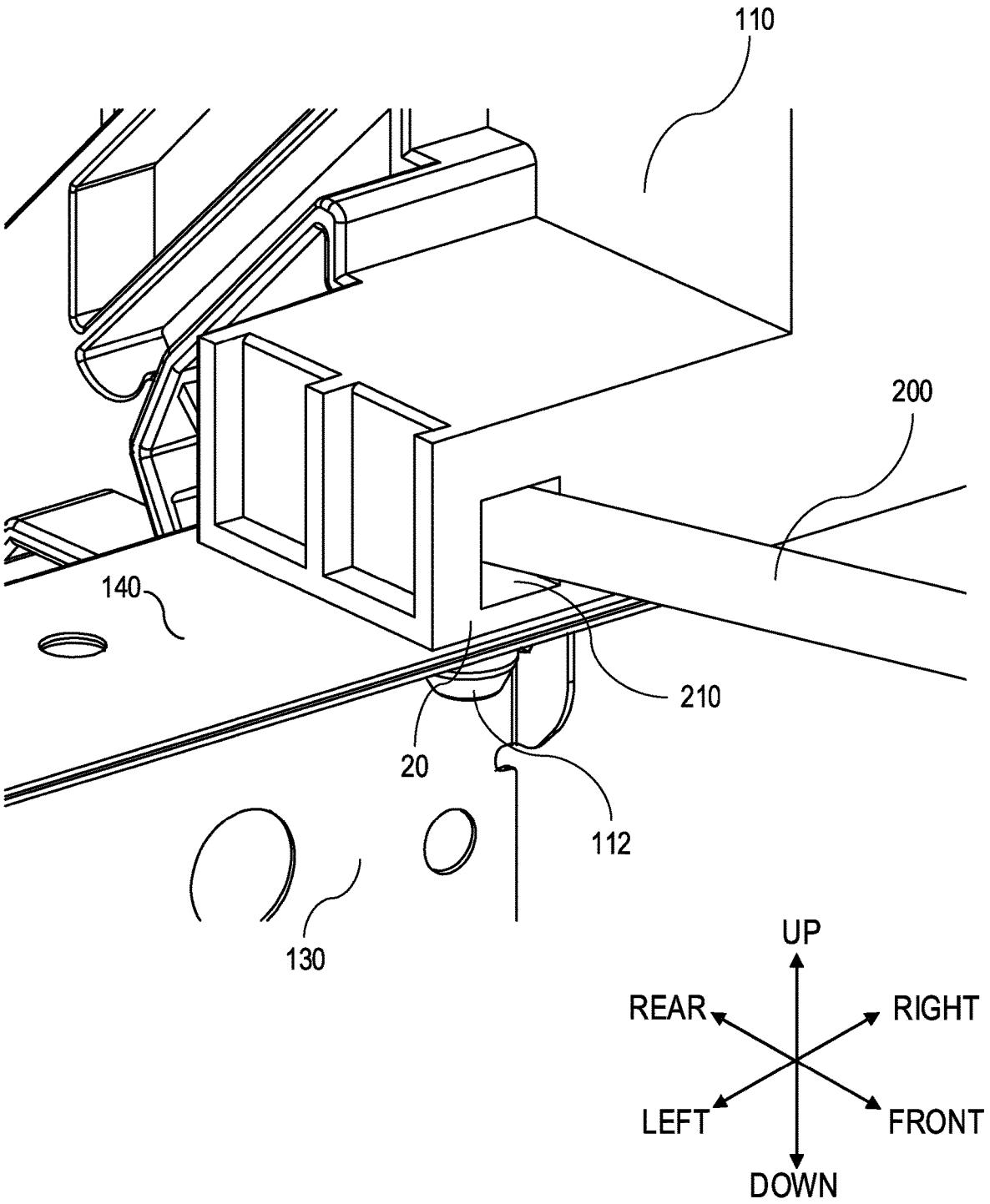
FIG. 12 is a perspective view for illustrating a method of disassembling the frames at a thermal-caulking fastening portion according to the third embodiment.
Figure 13:
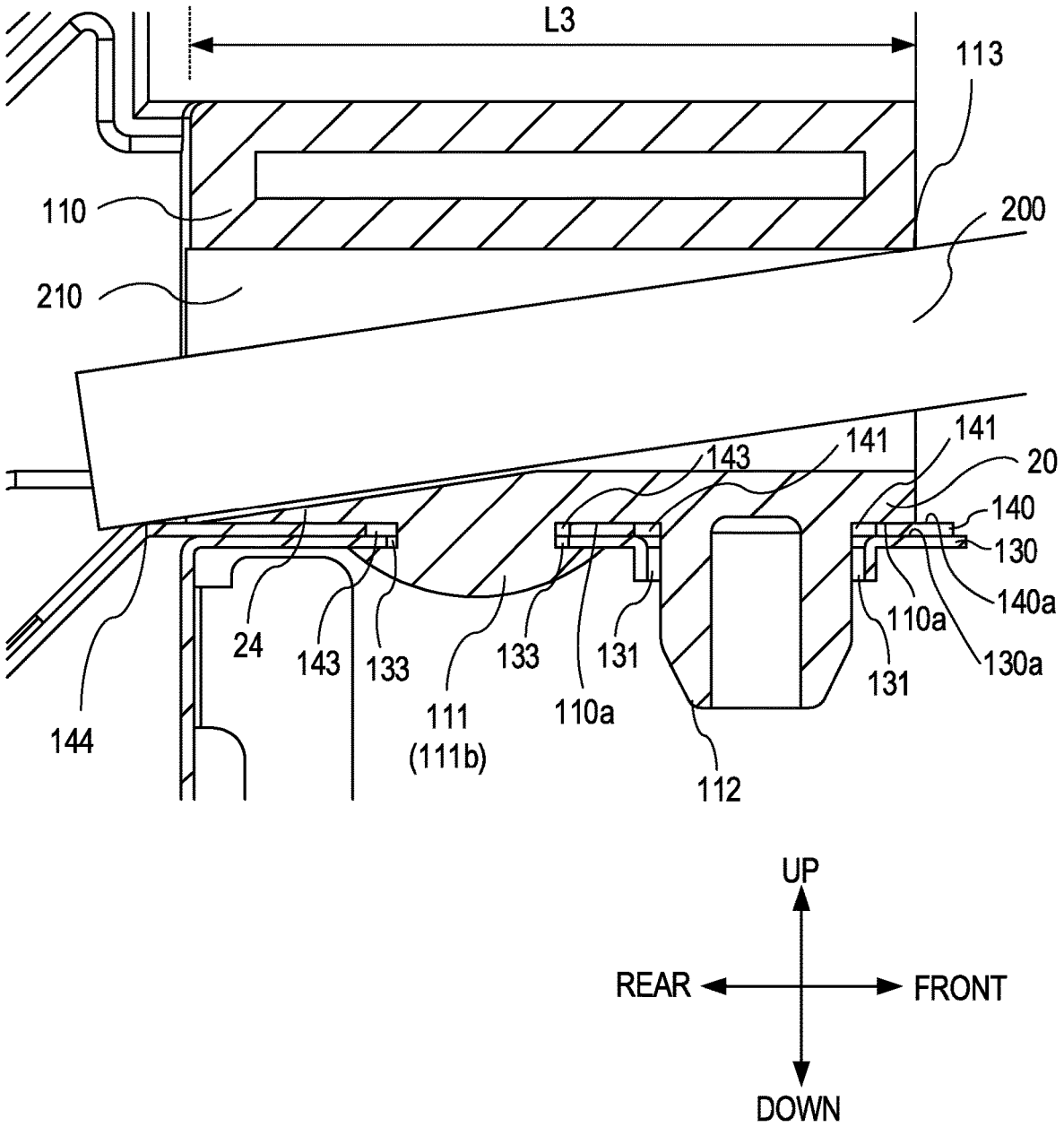
FIG. 13 is a sectional view for illustrating the method of disassembling the frames at the thermal-caulking fastening portion according to the third embodiment.

FIG. 12 is a view for illustrating a state in which the disassembly tool 200 is inserted in the disassembly hole 210 formed in the right frame 110 so as to disassemble the right frame 110 and the combination of the first front frame 130 and the second front frame 140. As illustrated in FIG. 12, as in the second embodiment, in the thermal-caulking fastening portion, the disassembly hole 210 for insertion of the disassembly tool 200 at the time of disassembly of the frames at the thermal-caulking fastening portion is formed in the right frame 110. FIG. 13 is a sectional view of the disassembly hole 210 illustrated in FIG. 12 under a state in which the disassembly tool 200 is inserted, which is taken along a plane orthogonal to an axis extending in the right-and-left direction of FIG. 12.

As illustrated in FIG. 13, in this embodiment, the first protrusion 111 and the second protrusion 112 of the fixing portion 20 are formed so as to be arranged side by side as in the first embodiment. The direction in which the first protrusion 111 and the second protrusion 112 are arranged side by side is the right-and-left direction of the image forming apparatus 1 in the first embodiment. In this embodiment, however, the direction in which the first protrusion 111 and the second protrusion 112 are arranged side by side is the fore-and-aft direction of the image forming apparatus 1. Specifically, the first protrusion 111 and the second protrusion 112 are arranged in the stated order in the direction from the rear side toward the front side of the image forming apparatus 1 of FIG. 13. Thus, a width L3 of the fixing portion 20 in the fore-and-aft direction of FIG. 13 is longer than the width L1 (FIG. 7) of the fixing portion 20 according to the first embodiment. Further, similarly, a length of the combination of the first front frame 130 and the second front frame 140 to be fastened to the right frame 110 in the fore-and-aft direction of FIG. 13 is longer than a length of the combination of the first front frame 130 and the second front frame 140 according to the first embodiment in the fore-and-aft direction. Further, the disassembly hole 210 passing through the right frame 110 in the fore-and-aft direction is formed vertically above the first protrusion 111 and the second protrusion 112 of the fixing portion 20 according to this embodiment.

[Fastening of Thermal-caulking Fastening Portion]

As illustrated in FIG. 13, the first front frame 130, which corresponds to the fastened member, has a second face 130*a*. A hole 133 and the positioning hole 131 are formed in the second face 130*a*. The first protrusion 111 passes through the hole 133, and the second protrusion 112 passes through the positioning hole 131. Similarly, the second front frame 140 has a second face 140*a*. Holes 141 and 143 are formed in the second face 140*a*. The first protrusion 111 passes through the hole 143, and the second protrusion 112 passes through the hole 141. The positioning hole 131 has a peripheral edge portion extending in a vertically downward direction so as to be fitted over the second protrusion 112.

Subsequently, a method of providing the fastening region by fastening the thermal-caulking fastening portion, and the first front frame 130 and the second front frame 140 is described. First, the right frame 110 having the fixing portion 20, the first front frame 130 having the positioning hole 131 and the hole 133, and the second front frame 140 having the holes 141 and 143 are prepared. Then, the first protrusion 111 of the fixing portion 20 is allowed to pass through the hole 143 of the second front frame 140 and the hole 133 of the first front frame 130, and the second protrusion 112 is allowed to pass through the hole 141 of the second front frame 140 and the positioning hole 131 of the first front frame 130 in the stated order. As a result, the second face 140*a* of the second front frame 140 and the second face 130*a* of the first front frame 130, which are opposed to the right frame 110, are superposed on the first face 110*a* of the right frame 110, which is opposed to the first front frame 130 and the second front frame 140, in the stated order. Then, the first protrusion 111 of the fixing portion 20 before the thermal caulking is heated to be changed in shape. As a result, the second face 130*a* and the second face 140*a* are thermally caulked so as to be sandwiched between the protrusion 111*b* corresponding to the first protrusion 111 after the thermal caulking, which has the distal end portion changed in shape to have the conical shape, and the first face 110*a*. Thus, the first front frame 130 and the second front frame 140 are fastened to the right frame 110.

Meanwhile, when the second protrusion 112 is inserted into the positioning hole 131 formed in the first front frame 130, the second protrusion 112 and the positioning hole 131 are fitted together to position the right frame 110 and the first front frame 130 with respect to each other. As described above, the second protrusion 112 is configured to position the right frame 110 and the first front frame 130. Further, the second protrusion 112 and the positioning hole 131 also function as a rotation stopper for the positioning.

The positioning hole 131 according to this embodiment has the same shape as the positioning hole 131 according to the first embodiment. Specifically, a width of the positioning hole 131 in the right-and-left direction is substantially the same as the diameter of the second protrusion 112 so that the second protrusion 112 inserted into the positioning hole 131 is fitted to the positioning hole 131. Meanwhile, a width of the positioning hole 131 in the fore-and-aft direction of FIG. 13 is larger than the diameter of the second protrusion 112 so that gaps are formed between the positioning hole 131 and the second protrusion 112 inserted therein at ends in the fore-and-aft direction of FIG. 13. Thus, the positioning hole 131 has an oval hole shape having a length in the fore-and-aft direction of FIG. 13, which is larger than a length in the right-and-left direction.

[Disassembly of Frames at Thermal-Caulking Fastening Portion]

Subsequently, a method of disassembling the frames at the thermal-caulking fastening portion according to the third embodiment is described. As illustrated in FIG. 13, the disassembly tool 200 inserted into the disassembly hole 210 passes through the disassembly hole 210, and the vertically lower portion of the distal end portion of the disassembly tool 200 in the insertion direction thereof (direction from a front side toward a rear side of FIG. 13) is in contact with the second corner portion 144 of the second front frame 140. Meanwhile, the vertically upper portion of the disassembly tool 200, which is located in the vicinity of the insertion port of the disassembly hole 210, is in contact with the first corner portion 113 of the insertion port of the disassembly hole 210 formed in the right frame 110. Then, a force is applied with the first corner portion 113 as a point of action and the second corner portion 144 as a fulcrum so as to push the disassembly tool 200 in an upward direction of FIG. 13 to thereby apply a force for pulling the right frame 110 away from the combination of the first front frame 130 and the second front frame 140 to the right frame 110. Even in this embodiment, as in the first embodiment, when the pulling force is applied by the disassembly tool 200, the second protrusion 112 can tilt without biting into the wall of the positioning hole 131 only in the insertion direction of the disassembly tool 200 (fore-and-aft direction of FIG. 13). As a result, the right frame 110 is pulled away from the combination of the first front frame 130 and the second front frame 140 to be separated (disassembled). An inclined surface 24 is formed as a part of a surface of the disassembly hole 210, which is located on the first front frame 130 and the second front frame 140 side and extends from a central portion to a rear side of FIG. 13, so that the disassembly tool 200 inserted into the disassembly hole 210 is brought into contact only with the first front frame 130 and the second front frame 140.

As described above, according to the third embodiment, both of the fastening strength and ease of disassembly at the thermal caulking portion can be achieved.

Other Embodiments

In the embodiments described above, the positioning hole 131 has an oval hole shape. However, the shape of the positioning hole 131 is not limited to the oval hole shape. For example, even when the positioning hole 131 has a rectangular shape, the same effects can be obtained. Further, as the disassembly hole 210, a hole having a quadrangular shape, for example, an oblong quadrangular shape, has been described. However, even when a shape of a formed hole is, for example, triangular, the same effects can be obtained. Further, in the embodiments described above, the boss shape has been described as the shape of the second protrusion 112. However, even when the shape of the second protrusion 112 is another protruding shape such as a rib shape, the same effects can be obtained.

Further, in the embodiments described above, the disassembly tool 200 is brought into contact with the second corner portion 144 of the second front frame 140 and the first corner portion 113 of the insertion port of the disassembly hole 210 formed in the right frame 110. When a force is applied with the first corner portion 113 as a point of action and the second corner portion 144 as a fulcrum so as to push the disassembly tool 200 in the vertically upward direction to thereby disassemble (separate) the right frame 110 from the first front frame 130 and the second front frame 140. For example, a rib, with which the disassembly tool 200 is to be brought into contact, may be formed on a ceiling portion corresponding to a vertically upper portion of the disassembly hole 210, and the frames may be disassembled (separated) at the thermal-caulking fastening portion with use of the disassembly tool 200 with the second corner portion 144 of the second front frame 140 as a fulcrum and the rib as a point of action.

Still further, in the embodiments described above, a monochrome type image forming apparatus including one process cartridge 14 to be mounted therein has been described as the image forming apparatus to which the present invention is applied. However, the application of the present invention is not limited to the monochrome type image forming apparatus. For example, in a case of an image forming apparatus configured to form a full-color image, four colors, that is, yellow, magenta, cyan, and black are used as colors of toners. Thus, the number of process cartridges to be mounted in the image forming apparatus is four. The present invention is also applicable to such an image forming apparatus configured to form a full-color image. Further, in the embodiments described above, a printer has been described as an example of a mode of the image forming apparatus. However, the present invention is also applicable to an image forming apparatus such as a copying machine, a facsimile machine, or a multifunction machine formed by combining functions of the copying machine and the facsimile machine.

As described above, even in other embodiments, both of the fastening strength and the ease of disassembly at the thermal caulking portion can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-014174, filed Jan. 30, 2020, which is hereby incorporated by reference herein in its entirety.

What is claimed is:

1. An image forming apparatus, comprising:

a first member having a first face, a first protrusion projecting from the first face, a second protrusion formed in a position apart from the first protrusion and projecting from the first face, and a groove portion formed in the first face; and a second member having a second face provided with a first hole and a second hole, wherein the first member and the second member are fastened to each other to form a frame configured to support an image forming portion configured to form an image on a recording material, wherein the first protrusion is inserted into the first hole, the second protrusion is inserted into the second hole, and the second face is superposed on the first face so that the groove portion located between the first member and the second member is in a visible state, and the second member is fixed to the first member so that the second face is sandwiched between a part of the first protrusion inserted in the first hole and the first face, and wherein the second hole in which the second protrusion has been inserted has a gap between the second hole and the second protrusion in an extending direction of the groove portion.

2. The image forming apparatus according to claim 1, wherein the groove portion is formed between the first protrusion and the second protrusion.

3. The image forming apparatus according to claim 2, wherein the second hole does not have a gap between the second hole and the second protrusion in a direction orthogonal to the extending direction of the groove portion, and wherein the second protrusion is fitted to the second hole in the direction orthogonal to the extending direction of the groove portion.

4. The image forming apparatus according to claim 1, wherein the first member is made of a resin, and the second member is made of a metal plate.

5. A method of manufacturing an image forming apparatus, the method comprising:

a first step of providing a first member having a first face, a first protrusion projecting from the first face, a second protrusion formed in a position apart from the first protrusion and projecting from the first face, and a groove portion formed in the first face;

a second step of providing a second member having a second face provided with a first hole and a second hole;

a third step of, after the first step and the second step, inserting the first protrusion into the first hole and the second protrusion into the second hole and superposing the second face on the first face so that the groove portion located between the first member and the second member is in a visible state; and a fourth step of, after the third step, deforming the first protrusion inserted in the first hole to fix the second member to the first member so that the second face is sandwiched between a part of the first protrusion and the first face, wherein the first member and the second member are fastened to each other to form a frame configured to support an image forming portion configured to form an image on a recording material, and wherein the second hole in which the second protrusion has been inserted has a gap between the second hole and the second protrusion in an extending direction of the groove portion.

6. The method according to claim 5, wherein the groove portion is formed between the first protrusion and the second protrusion.

7. The method according to claim 6, wherein the second hole does not have a gap between the second hole and the second protrusion in a direction orthogonal to the extending direction of the groove portion, and wherein the second protrusion is fitted to the second hole in the direction orthogonal to the extending direction of the groove portion.

8. A method of disassembling an image forming apparatus comprising a first member having a first face, a first protrusion projecting from the first face, a second protrusion formed in a position apart from the first protrusion and projecting from the first face, and a groove portion formed in the first face, and a second member having a second face provided with a first hole and a second hole, wherein the image forming apparatus includes a frame formed by inserting the second protrusion into the second hole, superposing the second face on the first face, and fixing the second member to the first member so that the second face is sandwiched between a part of the first protrusion inserted in the first hole and the first face in a state in which the groove portion located between the first member and the second member is in a visible state, and wherein the second hole in which the second protrusion has been inserted has a gap between the second hole and the second protrusion in an extending direction of the groove portion, the method comprising:

inserting a tool into the groove portion; and moving the tool in a direction of separating the second face away from the first face so that the first member and the second member are separated from each other.

9. The method according to claim 8, wherein a part of the tool, which is located on a downstream side in an insertion direction of the tool, is brought into contact with one of the first member and the second member, and a part of the tool, which is located on an upstream side in the insertion direction of the tool, is brought into contact with another one of the first member and the second member.

10. The method according to claim 8, wherein the first member is made of a resin, and the second member is made of a metal plate.

* * * * *